US012741787B2

(12) United States Patent
Bösch et al.

(10) Patent No.: US 12,741,787 B2
(45) Date of Patent: Sep. 22, 2026

(54) EXTRUSION-BLOW-MOLDED CONTAINER WITH A SCREW CAP

(71) Applicant: ALPLA WERKE ALWIN LEHNER GMBH & CO. KG, Hard (AT)

(72) Inventors: Klemens Bösch, Lustenau (AT); Thomas Bohle, Alberschwende (AT)

(73) Assignee: ALPLA WERKE ALWIN LEHNER GMBH & CO. KG, Hard (AT)

( * ) Notice: Subject to any disclaimer, the term of this patent is extended or adjusted under 35 U.S.C. 154(b) by 0 days.

(21) Appl. No.: 18/994,666

(22) PCT Filed: Jul. 26, 2023

(86) PCT No.: PCT/EP2023/070731
§ 371 (c)(1),
(2) Date: Jan. 15, 2025

(87) PCT Pub. No.: WO2024/023167
PCT Pub. Date: Feb. 1, 2024

(65) Prior Publication Data

US 2026/0028163 A1 Jan. 29, 2026

(30) Foreign Application Priority Data

Jul. 28, 2022 (CH) ..... CH000913/2022

(51) Int. Cl.
*B65D 41/04* (2006.01)
*B65D 1/02* (2006.01)

(52) U.S. Cl.
CPC ..... *B65D 41/0414* (2013.01); *B65D 1/0207* (2013.01); *B65D 1/0246* (2013.01); *B65D 1/0292* (2013.01); *B65D 2501/0081* (2013.01)

(58) Field of Classification Search
CPC ..... B65D 41/0414; B65D 1/0207; B65D 1/0246; B65D 1/023
See application file for complete search history.

(56) References Cited

U.S. PATENT DOCUMENTS 4,390,111 A * 6/1983 Robbins ..... B65D 41/0414 215/354
5,060,813 A * 10/1991 Gollasch ..... B65D 41/0442 215/354

(Continued)

FOREIGN PATENT DOCUMENTS

EP 4001155 A1 5/2022
WO 2016019321 A1 2/2016

OTHER PUBLICATIONS

International Search Report issued by the European Patent Office acting as the International Searching Authority in relation to International Application No. PCT/EP2023/070731 dated Sep. 26, 2023 (6 pages) along with English language translation (2 pages).

(Continued)

*Primary Examiner* — Jeffrey R Allen
(74) *Attorney, Agent, or Firm* — Robert P. Michal, Esq.; Rimon PC

(57) ABSTRACT

A container with a screw cap is produced from a plastics material, by blow molding, and has a body with a first end and a second end, which is located opposite the first end, and with a lateral surface located therebetween, wherein a base with a standing surface is formed at the second end and an opening is formed at the first end, and wherein the opening is defined by a neck, which encloses the opening and is formed in one piece with the container, an external thread being formed on the neck, wherein the screw cap is provided with an internal thread which, when the screw cap has been placed in position, interacts with the external thread, and wherein a sealing element is formed on the inner side of the screw cap.

18 Claims, 5 Drawing Sheets

(56) References Cited

U.S. PATENT DOCUMENTS

Figure 1:
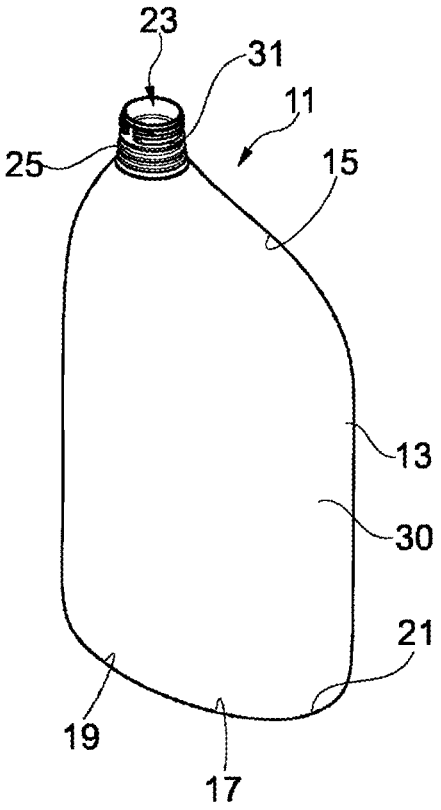

| | | | | |
|---|---|---|---|---|
| 5,964,383 | A | 10/1999 | Cargile | |
| 2011/0017625 | A1* | 1/2011 | Wycoff ..... | B65D 51/242<br>206/508 |
| 2011/0220607 | A1 | 9/2011 | Mukunoki | |

OTHER PUBLICATIONS

Written Opinion of the International Searching Authority issued by the European Patent Office acting as the International Searching Authority in relation to International Application No. PCT/EP2023/070731 dated Sep. 26, 2023 (4 pages).

* cited by examiner

EXTRUSION-BLOW-MOLDED CONTAINER WITH A SCREW CAP

CROSS-REFERENCE TO RELATED APPLICATIONS

This application is a national phase entry under 35 U.S.C. 371 of PCT International Application No. PCT/EP2023/070731 filed Jul. 26, 2023, which claims priority to Swiss Patent Application No. CH000913/2022, filed Jul. 28, 2022, the disclosure of each of these applications is expressly incorporated herein by reference in their entirety.

FIELD OF THE INVENTION

The invention relates to a container with a screw cap, wherein the container is made of a plastics material, in particular by extrusion blow molding according to the preamble of the claim.

PRIOR ART

The production of plastic containers, especially plastic bottles, e.g., made of polyethylene or polypropylene, takes place in extrusion blow molds. In this case, plastic suitable for blow molding is plasticized and introduced into a tube head by means of an extruder. In the tube head, the plastic is formed into a tube, which is introduced into a blow-molding tool. The hose is introduced into the blow-molding tool, inflated by overpressure of a gas when the tool is closed so that the hose expands and is pressed against an inner wall of a cavity of the blow-molding tool, and assumes the shape of the inner wall, which has a shape that is the negative of a container. The container blown out of the hose is cooled by means of the inner wall until the plastic is hardened. Subsequently, the container is removed from the opened blow-molding tool. In a separate step, the so-called slugs, which are formed by the protrusion of the tube during the closing of the blow mold and are generally connected to the removed container, are cut off and can be directed to recycling. The hose can be single-layer or multi-layered.

As a rule, the outlet openings are formed at one end of the container during the blow-molding process. Accordingly, during the filling process, the containers are filled via the outlet opening. Thus, the filling speed at the filling line is dependent upon the cross-section of the outlet opening and the consistency of the product with which a container is to be filled.

In order to enable an increased filling rate, WO 2017/072185 A1 discloses an extrusion blow-molded container that has a first open end and a second end. The first end has a first and a second sealing surface. The sealing surfaces surround a filling opening and can be connected in a fluid-tight manner after filling. The second end is formed as a container base with a standing surface. The fact that the filling opening can extend at most over the entire cross section of the container makes the rapid filling of the container possible.

For pouring the filling material, the container must be cut open, or a closure element must be laminated in-between the sealing surfaces with a pour opening. If the container is cut open, a pouring opening is produced, which is less user-friendly because an auxiliary means is needed to open it, and filling material can easily be spilled during pouring. If a closure element is present, the closure element must be inserted between the sealing surfaces before it can be welded thereto. In addition, the closure element can be produced from a plastic different than that of the container, as a result of which single-type disposal of the container is not possible.

In order to overcome this disadvantage, a filling opening and a separate pouring opening can be provided on an extrusion blow-molded container. It is preferred if the filling opening is greater than the pouring opening. As a result, the container can be filled quickly, and the filling material can be precisely poured out or transferred into another container. In addition, the material requirement is reduced when a screw cap for a small pouring opening is provided. However, the use of such containers on conventional filling systems is not possible without special adaptations due to the geometry of the containers.

Because these containers are designed specifically for use as refill packaging, special efforts are made to manufacture these containers using the least possible amount of material. The pouring opening is of central importance in the production of extrusion blow-molded containers if a thread is formed on it, which is intended to interact with a closure element in the form of a screw cap.

The aim of reducing the use of materials conflicts with the stability of the thread, which is necessary so that the container can be tightly closed with the screw cap.

The container is preferably made of HDPE, wherein the proportion of recycled HDPE is between 10 and 100 wt. %. This makes the container very easy to extrusion blow-mold and is environmentally friendly and gentle on materials.

OBJECT OF THE INVENTION

The object of the invention is to provide a container with a screw cap which is designed in such a way that the container is reliably, i.e., in particular tightly, closed with the screw cap.

DESCRIPTION

The stated object, in a container produced from a plastics material, in particular by extrusion blow molding, with a screw cap, is achieved by the features listed in the independent claim. The dependent claims relate to developments and/or advantageous alternative embodiments.

Thus, the invention relates to a combination of a container with the following features: the container is produced from a plastics material, in particular by blow molding, and has a body with a first end and a second end, which is located substantially opposite the first end, and with a lateral surface located therebetween, wherein a base with a standing surface is formed at the second end and an opening is formed at the first end, and wherein the opening is defined by a neck, which encloses the opening and is formed in one piece with the container, and an external thread is formed on the neck, and a screw cap having an internal thread.

This combination is characterized in that the external thread attains its final rigidity through the screw connection with the screw cap. Since the container is a lightweight container with thin walls for refill purposes, this means that the neck with the external thread is also thin-walled and less stable. However, this instability can be surprisingly compensated for by tightening the screw cap on the neck. Due to the thin neck wall and the low external thread thickness, the external thread can be compressed along the screw axis by the screw cap. In addition to the neck, the external thread can thereby also be formed in a material-saving manner. The rigidity is achieved through a kind of "accordion effect," and the opening is reliably sealed.

In a particularly preferred embodiment of the invention, the sealing effect between the sealing element and the neck is realized in that the neck is widened when the sealing element projects into the neck. This type of sealing function makes it possible for the second neck to be designed to be particularly thin-walled, since the necessary rigidity for the production of the seal is provided by the sealing element. This also allows the neck to be formed using little plastics material.

The invention is also characterized by the fact that the wall thickness of the screw cap is greater than the wall thickness of the container. This means that the rigidity of the screw cap is greater than that of the container neck. This means that the typically low rigidity of a refill bag can be used in a surprising way in combination with the screw cap to create a tight and stable seal between the screw cap and the container neck.

In a further preferred embodiment of the invention, the container has a wall thickness of 0.2-0.4 mm. This makes the container perfect as a refill container. The low wall thickness not only saves upon resources, but also allows the container to collapse when emptied. In addition, the low wall thickness in the region of the neck allows it to adapt flexibly to the sealing element of the screw cap, and the "accordion effect" described above can be achieved. The screw cap expediently has a wall thickness of 0.7-1 mm. Such wall thickness dimensioning ensures sufficient stability of the sealing element and the internal thread, to guarantee reliable sealing of the container opening.

It has proven advantageous if the wall thickness of the neck decreases towards its open edge. The reduction in the wall thickness of the neck can be done in one step or by a continuous reduction. Due to the low wall thickness at the open edge, this is particularly flexible and can be easily expanded when the sealing element is pressed into the opening.

In a further, preferred embodiment of the invention, the screw cap has a projection to which a tool can be applied and a torque can be transmitted from the tool to the cap. As a result, the screw cap can also be screwed onto the neck for the first time when there is insufficient space on the broadside of the container for a standard tool (capper) for attaching the cap to the second neck, and the capper thus cannot grip the screw cap on the outer side thereof. The projection is preferably a hexagon socket or another form-fitting connection by means of a polygon.

The projection is expediently a depression, which acts as the sealing element. As a result, the sealing element fulfills two functions, and the screw cap requires less plastics material for its production in the case of a corresponding design. The invention is preferably characterized in that the opening is defined by a neck surrounding the opening, which neck is formed integrally with the container, and that an external thread is formed on the neck, which thread can interact with the internal thread of a screw cap. This allows the container to be manufactured particularly quickly and cost-effectively. The one-piece design also guarantees that the plastics material of the container and the plastics material forming the opening are identical. These features make further production steps obsolete, and the neck together with the container can be disposed of separately.

In a particularly preferred embodiment of the invention, the container is free of a further opening. This means that the blow mold can be produced cost-effectively, and price drivers in the form of complicated blow molds are avoided. Compared to the variant with two necks, the welding process on the filling line is eliminated here. This eliminates the need to install a welding system on the filling line, resulting in significant cost savings for the customer.

Expediently, a first and a second shoulder adjoin the neck. This allows the opening to have an optimized shape for the intended use of the refill container and allows it to merge into the lateral surface of the container in a flowing shape. It is therefore also preferred if the first and second shoulders merge into the lateral surface of the container.

In a further preferred embodiment of the invention, the opening is shaped such that, in a plan view of the container, it lies within the outline of the container base. As a result, the requirements for the blow mold are simplified, and the neck can be shaped in a dimensionally accurate manner. In addition, this enables simplified palletizing, because the neck does not protrude. This is also advantageous if the container is to be decorated, i.e., for example, printed, if labels or the like are to be glued to the container, or if the container is to be wrapped with a shrink film.

It is advantageous if the opening is located centrally within the outline of the container base. This gives the container a symmetrical shape and is reminiscent of a bottle.

It can also be advantageous if the base has a main axis and a secondary axis, and the opening is located off-center on the main axis. This makes it easier to refill filling material from the container into an existing container without spilling the filling material.

Expediently, the first shoulder has a convex shape starting from the neck. The first shoulder therefore has the shape of an arch curved outwards, allowing the neck to be positioned far outwards on the main axis, depending upon the application of the container.

It can also be expedient if the first and second shoulders have a concave shape starting from the neck and run out into the lateral surface in a convex shape. The two shoulders can therefore be S-shaped, which enables flow-improved pouring. The central/middle position of the neck also ensures that the shoulder angle can be made steeper. This ensures better compression pressure behavior. Since the refill container is symmetrical, there is no need to orient the bottle on the filling line. This makes it possible to reduce costs.

In another particularly preferred embodiment, the neck is blow-molded together with the container. As a result, the entire container is manufactured in a blow mold and needs only still to be filled and closed with the screw cap. No further processing steps are necessary, and the container is made from a single type of plastics material.

Figure 2:
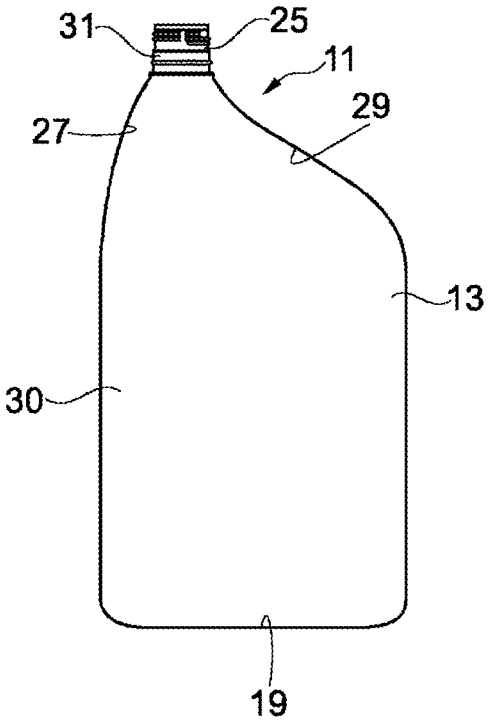
Figure 3:
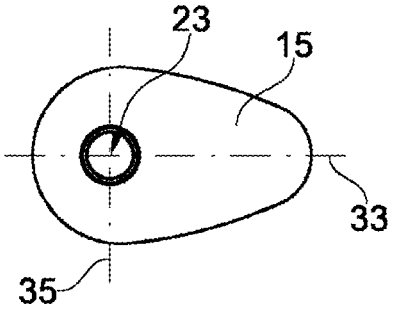
Figure 4:
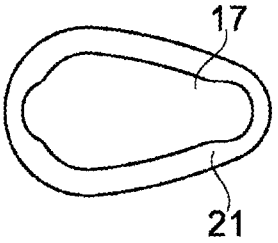
Figure 5:
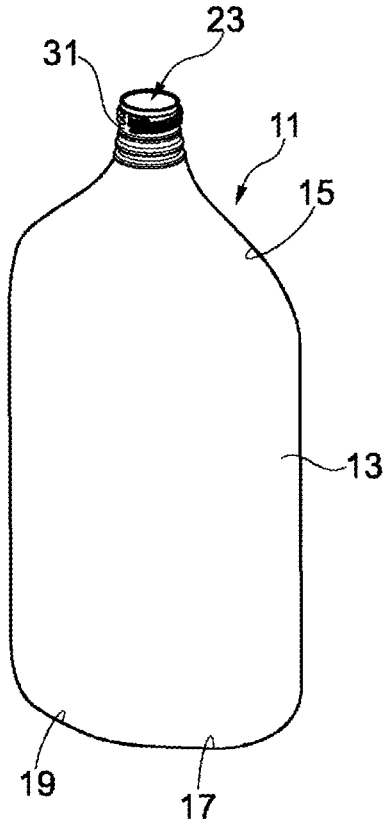
Figure 6:
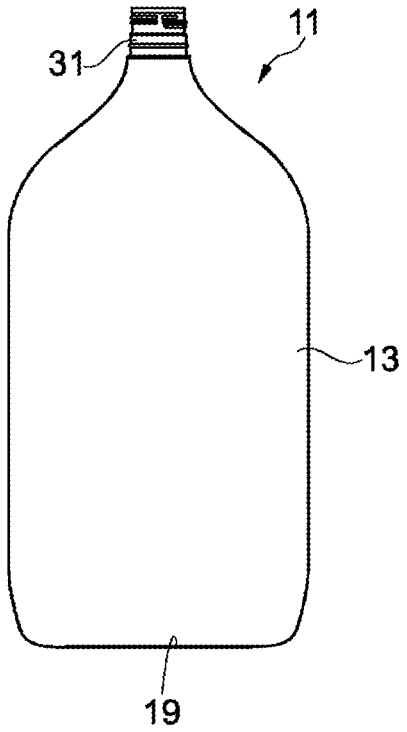
Figure 7:
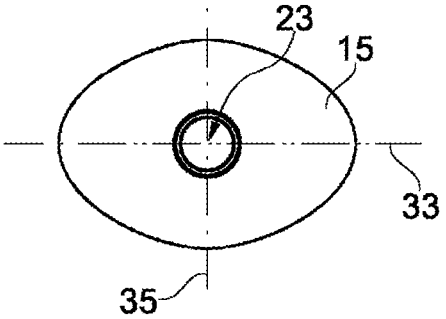
Figure 8:
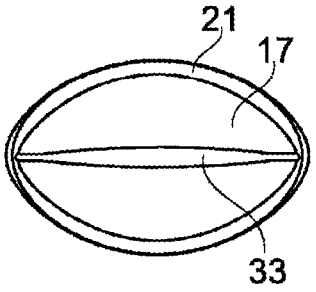
Figure 9:
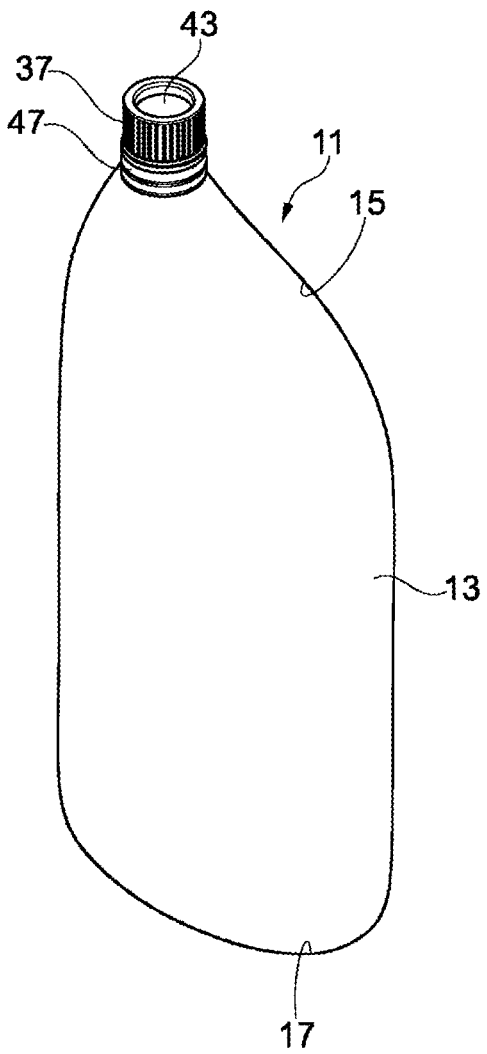
Figure 10:
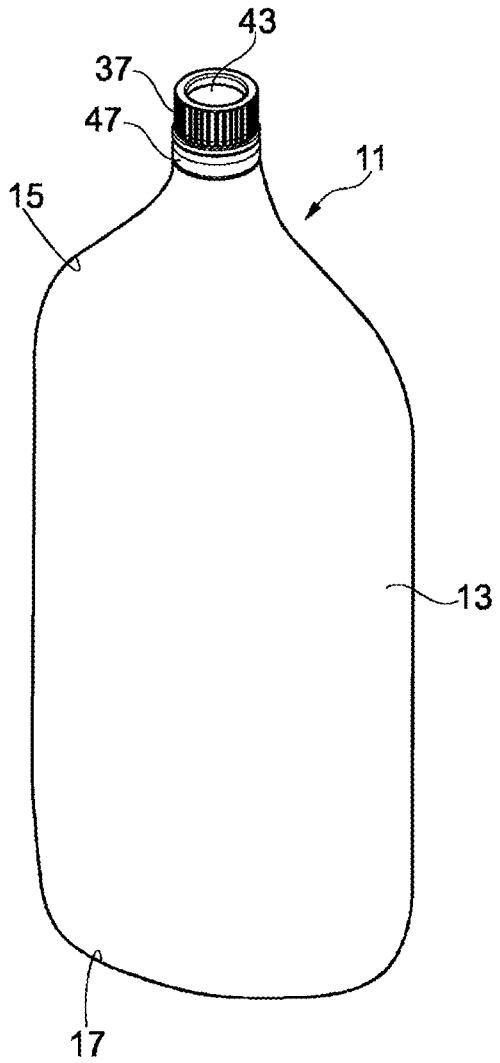
Figure 11:
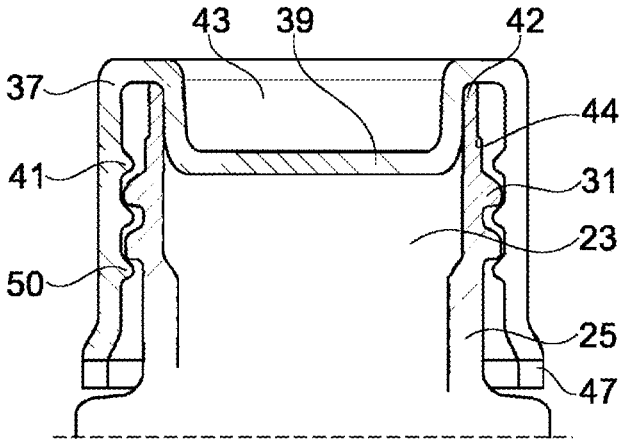
Figure 12:
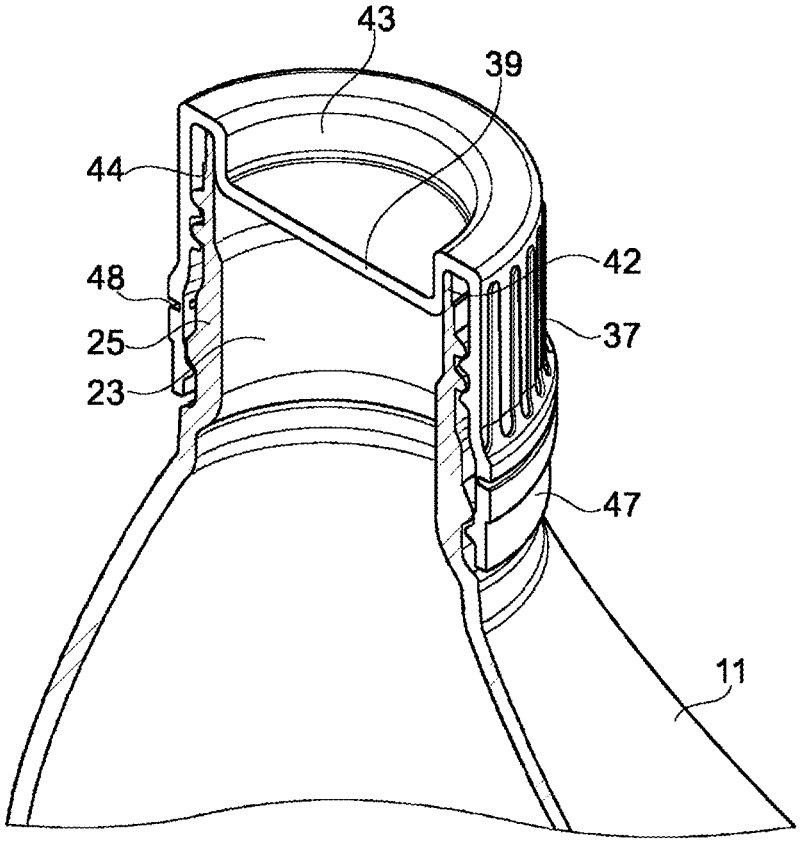
Figure 13:
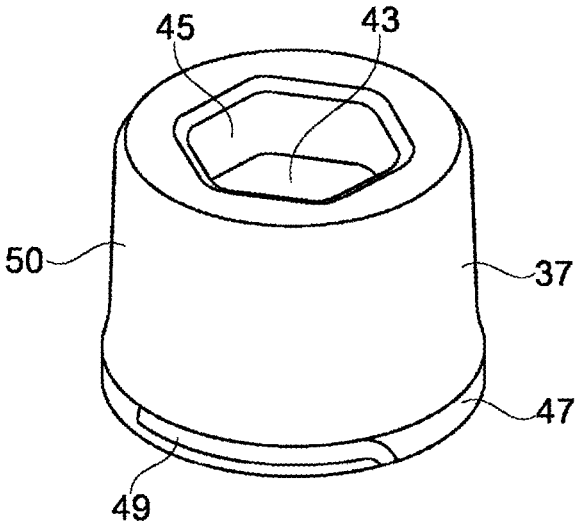

Further advantages and features become apparent from the following description of several exemplary embodiments of the invention with reference to the schematic representations. In the figures, in a representation that is not to scale:

FIG. 1: is a perspectival view of an extrusion blow-molded container with a neck formed from the container, enclosing an opening, in a first embodiment;

FIG. 2: is a side view of the container from FIG. 1;

FIG. 3: is a plan view of the container from FIG. 1;

FIG. 4: is a bottom view of the container from FIG. 1;

FIG. 5: is a perspectival view of the extrusion blow-molded container with a neck formed from the container, enclosing an opening, in a second embodiment;

FIG. 6: is a side view of the container from FIG. 5;

FIG. 7: is a plan view of the container from FIG. 5;

FIG. 8: is a bottom view of the container from FIG. 5;

FIG. 9: shows the first embodiment of the container with a screwed-on cap;

FIG. 10: shows the second embodiment of the container with a screwed-on cap;

FIG. 11: is a cross-section through the container neck and the screw cap screwed onto the neck;

FIG. 12: is a perspectival sectional view through the container neck and the screw cap screwed onto the neck; and FIG. 13: is a perspectival view of the screw cap.

FIGS. 1 to 4 and 9, or 5 and 8 to 10, show possible embodiments of a container that is produced from a plastics material by extrusion blow molding and is designated overall by reference sign 11. The container 11 is intended in particular as a so-called "refill container." This means that it is as lightweight as possible and is stabilized by the filling material when it is full. Nevertheless, it has sufficient inherent stability to permanently maintain its container shape. After the filling material has been completely transferred into an existing container, the refill container 11 can be folded up so small, due to its relatively low inherent stability, that its filling volume is almost zero. This approach is extremely sustainable, especially if the container is made from recycled plastics material. The container can be made of polyethylene or polypropylene.

The container 11 has a body 13 that has a first end 15 and a second end 17 that is substantially opposite the first end 15. The second end 17 is closed in a fluid-tight manner and is designed as a base 19 on which a standing surface 21 is formed.

An opening 23 is blow-molded together with the remaining container 11, at the first end, and is therefore simultaneously formed with the container 11 in the blow mold by inflating the container material. Preferably, the container 11 is free of any further opening. As a result, the blow mold can be designed simply, the container 11 requires less material for its production, and the opening can be closed by a screw cap 37 after filling. Compared to the variant with two necks, the welding process on the filling line is eliminated here. As a result, no welding system needs to be installed on the filling line, making the filling system more cost-effective to purchase and operate.

The opening 23 is defined by a neck 25 which surrounds the opening 23 and which the first and second shoulders 27, 29 adjoin. The shoulders 27, 29 merge seamlessly into the lateral surface 30 of the container 11.

In a particularly advantageous embodiment, the opening 23 is located within the mold separation and within the outline of the base 19 (FIG. 3 and FIG. 7). This ensures that sufficient material is present for the formation of an external thread 31 on the neck 25.

FIGS. 3 and 7 show that the base 19 of the container can have a main axis 33 and a secondary axis 35. The opening 23 or the neck 25 are located on the main axis, such that the requirement described in the last paragraph is met.

In the first exemplary embodiment according to FIG. 1 to 4, the opening 23 is arranged off-center on the main axis 33 in the plan view. In the second exemplary embodiment according to FIG. 5 to 8, the opening is arranged centrally on the main axis.

In the first embodiment, the first shoulder 27 extends in a convex manner starting from the neck 25, whereas the second shoulder 29 has a concave shape from the neck and runs out in the lateral surface in a convex shape. This places the neck 25 in a convenient position to allow filling material to be transferred into another container without spilling.

In the second embodiment, the first and second shoulders 27, 29 have a concave shape starting from the neck 25 and run out into the lateral surface 30 in a convex shape.

The external thread 31 has been developed specifically for the use of lightweight packagings, in particular refill containers. It can be formed with very little material and only attains its final stiffness through the screw connection with the screw cap 37, since it is compressed by the attached screw cap 37.

The screw cap 37 has a sealing element 39 and an internal thread 41, which projects into the opening 23 when the screw cap is attached to the neck 25. In addition, the screw cap has an internal thread 41, which interacts with the external thread 31. The sealing element 39 is designed to be rigid in such a way that it can widen the thin-walled neck 25. This results in the sealing effect between the neck 25 and the screw cap 37. The rigidity of the screw cap 37 and consequently of the sealing element 39 and the internal thread 41 is achieved by the screw cap 37 having a wall thickness of, for example, 0.8 mm.

FIGS. 11 and 12 show the open edge 42 of the neck, the wall thickness of which is reduced. The reduction can be achieved via a step 44. The wall thickness of the open edge is preferably 0.2 mm, wherein the wall thickness of the container is between 0.2 mm and 0.4 mm. Due to this particularly low wall thickness, the neck is flexible and can be easily expanded in the radial direction by the sealing element 39. By screwing on the screw cap 37, a reliable seal can be created while simultaneously stabilizing the thin-walled neck 25.

In contrast to the prior art, in which the screw cap has the material flexibility necessary for the sealing effect, according to the invention, the screw cap 37 has the necessary increased stability, and the container neck 25 has the necessary flexibility.

The screw cap 37 preferably has a depression 43, which acts as the sealing element 39. The depression can have a projection for a tool in order to be able to transmit a torque to the screw cap 37 in a form-fitting manner. The projection can be a hexagon socket 45 or another polygon.

The screw cap can also have a guarantee ring 47 with predetermined breaking webs 48, as shown in FIG. 9 to 13. The neck 25 also provides sufficient height that a retaining band 49 can be provided on the guarantee ring 47. The retaining band 49 holds the unscrewed threaded part 50 captively to the guarantee ring 47 or to the neck 25 after unscrewing.

The base 19 may have a groove 51 (FIG. 8) into which the base 19 can be folded. After emptying the refill container, it can be folded up particularly small thanks to the groove 47 and requires little space when disposed of. FIGS. 3 and 4 show a base shape or a container cross-section which has the shape of a cam. This cam shape ensures that the user "intuitively" grips the bottle on the wider side.

The extrusion blow-molded container 11 is integrally formed, and the neck 25 together with the container body 13 is blown in one mold. The neck is therefore an integral component of the container 11 and does not have to be subsequently inserted therein and connected thereto. The container 11 is characterized by the fact that it is lightweight and thin-walled, and yet has a sufficiently stable and accordingly tight screw cap. The stability is created by tightening the screw cap 37 on the neck 25, since this compresses and stabilizes the external thread 31 along the longitudinal axis and the thin-walled neck 25, which can be widened at its open edge 42 by the sealing element 39.

LIST OF REFERENCE SIGNS

11 Container
13 Body of the container
15 First end
17 Second end

19 Base
21 Standing surface
23 Opening
25 Neck
27 First shoulder
29 Second shoulder
30 Lateral surface
31 External thread
33 Main axis
35 Secondary axis
37 Screw cap
39 Sealing element
41 Internal thread
42 Open edge of the support ring
43 Depression
44 Step
45 Hexagon socket
47 Security ring
48 Break-off webs
49 Holding strip
50 Threaded part
51 Groove

The invention claimed is:

1. Container with a screw cap, wherein the container is produced from a plastics material, in particular by blow molding, and has a body with a first end and a second end, which is located substantially opposite the first end, and with a lateral surface located therebetween, wherein a base with a standing surface is formed at the second end and an opening is formed at the first end, and wherein the opening is defined by a neck, which encloses the opening and is formed in one piece with the container, and an external thread is formed on the neck, wherein the screw cap has a wall thickness and is provided with an internal thread which, when the screw cap has been placed in position, interacts with the external thread, and wherein a sealing element is formed on the inner side of the screw cap and, when the latter has been placed in position, projects into the opening, wherein the external thread attains its final rigidity by being screw-connected to the screw cap; and wherein the wall thickness of the screw cap is greater than a wall thickness of the container where the external thread is formed on the neck, wherein the wall thickness of the container is has a wall thickness of 0.2-0.4 mm.

2. The container with a screw cap according to claim 1, wherein the sealing effect between the sealing element and the neck is realized in that the neck is widened when the sealing element projects into the neck.

3. The container with a screw cap according to claim 1, wherein the wall thickness of the screw cap is greater than the wall thickness of the body of the container.

4. The container with a screw cap according to claim 1, wherein the wall thickness of the screw cap is 0.7-1 mm.

5. The container with a screw cap according to claim 1, wherein a wall thickness of the neck decreases in the direction of the opening at the first end.

6. The container with a screw cap according to claim 1, wherein the screw cap has a projection to which a tool can be applied, and a torque can be transmitted from the tool to the cap.

7. The container with a screw cap according to claim 6, wherein the projection is a depression which acts as the sealing element.

8. The container with a screw cap according to claim 1, wherein the container serves to refill filling material into an existing container and can be folded to a filling volume close to zero after emptying.

9. The container with a screw cap according to claim 1, wherein the container is free of a further opening.

10. The container with a screw cap according to claim 1, wherein a first and a second shoulder adjoin the neck.

11. The container with a screw cap according to claim 1, wherein the container further includes first and second shoulders which transition into the lateral surface of the container.

12. The container with a screw cap according to claim 1, wherein the opening is formed in such a way that it is within an outline of the base in a plan view of the container.

13. The container with a screw cap according to claim 1, wherein the opening is located centrally within an outline of the base.

14. The container with a screw cap according to claim 1, wherein the base has a main axis and a secondary axis, and the opening is located off-center on the main axis.

15. The container with a screw cap according to claim 1, wherein the container includes at least a first shoulder which has a convex shape starting from the neck.

16. The container with a screw cap according to claim 1, wherein the container includes first and second shoulders, and the first and second shoulders have a concave shape starting from the neck and run out into the lateral surface in a convex shape.

17. The container with a screw cap according to claim 1, wherein the neck is blow-molded together with the container.

18. The container with a screw cap according to claim 1, wherein the container is made of HDPE, wherein the proportion of recycled HDPE is between 10 and 100 wt. %.

* * * * *